United States Patent [19]

Yamada et al.

[11] Patent Number: 4,858,210

[45] Date of Patent: Aug. 15, 1989

[54] APPARATUS WITH SYNTHETIC RESIN HAND SHAFT

[75] Inventors: Wataru Yamada; Satoshi Fujio; Kenichi Nakamura, all of Tokyo, Japan

[73] Assignee: Casio Computer Co., Ltd., Tokyo, Japan

[21] Appl. No.: 118,259

[22] Filed: Nov. 9, 1987

[30] Foreign Application Priority Data

Nov. 19, 1986 [JP] Japan ..... 61-276230
Nov. 19, 1986 [JP] Japan ..... 61-178007[U]
Nov. 19, 1986 [JP] Japan ..... 61-178015[U]

[51] Int. Cl.[4] ..... G04B 19/04
[52] U.S. Cl. ..... 368/238; 368/228
[58] Field of Search ..... 368/88, 244

[56] References Cited

U.S. PATENT DOCUMENTS 3,979,901 9/1976 Nakagawa .
4,069,658 1/1978 Ito ..... 368/244
4,711,584 12/1987 Tanazawa et al. ..... 368/88

*Primary Examiner*—Bernard Roskoski
*Attorney, Agent, or Firm*—Frishauf, Holtz, Goodman & Woodward

[57] ABSTRACT

An apparatus has a hand shaft formed of synthetic resin which has a first hand shaft portion and a second hand shaft portion having an insertion hole into which the first hand shaft portion is inserted to be rotatable. The first hand shaft portion is formed in a columnar shape by molding with the synthetic resin containing fiber-like reinforcing materials. In the synthetic resin forming the first hand shaft portion, the longitudinal axes of fiber-like reinforcing materials are oriented to be consistent with the longitudinal axis of the first hand shaft.

24 Claims, 5 Drawing Sheets

APPARATUS WITH SYNTHETIC RESIN HAND SHAFT

BACKGROUND OF THE INVENTION

The present invention relates to an apparatus having a hand shaft formed of synthetic resin, on which a hand is mounted.

A typical conventional hand shaft for use in an analog watch is disclosed, for example, in U.S. Pat. No. 3,979,901. A second wheel for moving a second hand is rotatably supported on a main plate, and its shaft portion is disposed rotatably in the cylindrical shaft portion of the center wheel. In this apparatus, the shaft portion of the second wheel must have high strength, because a strong force is applied when the second hand is mounted thereto. Thus, the second wheel is, heretofore, made of metal. In the second wheel formed of the metal, a plurality of projections are formed at a part of the shaft portion of the second wheel so as to contact the inner surface of the cylindrical shaft portion of the center wheel and oil is coated on the projections to reduce the frictional resistance between the shaft portion of the second wheel and the inner surface of the cylindrical shaft portion of the center wheel. Forming the projections on the shaft portion of the second wheel causes the structure of the second wheel to be complicated so that the working becomes troublesome and the cost becomes high.

Recently, the gears of the watch have been formed of synthetic resin. Thus, it is tried to form the shaft portion of the second wheel, on which a second hand is mounted, of synthetic resin in a conventional process, but since the diameter of the shaft portion is very small, the shaft portion might sometimes be deformed or damaged when the hand is press-fitted to the shaft portion.

SUMMARY OF THE INVENTION

Accordingly, an object of the present invention is to provide an apparatus having a synthetic resin hand shaft which can be simply and easily formed, which has low frictional resistance to smoothly rotate, and which has sufficient strength so as not to be deformed nor damaged when the hand is mounted thereto.

In order to achieve the above object of the present invention, there is provided an apparatus comprising a synthetic resin hand shaft having a first hand shaft portion on which a first hand is mounted to be rotatably driven therewith, the first hand shaft portion being formed of a synthetic resin in which fiber-like reinforcing materials are contained, with their longitudinal axes arranged parallel to the longitudinal axis of the first hand shaft portion, and a second hand shaft portion to the end of which a second hand is mounted, the second hand shaft portion having an insertion hole to which the first hand shaft portion is inserted.

In the construction described above, since the longitudinal axes of the fiber-like reinforcing material in the synthetic resin forming the first hand shaft portion are arranged to be consistent with the longitudinal axis of the first hand shaft portion, the first hand shaft portion has sufficient strength in its longitudinal direction. Hence, the first hand shaft portion is not deformed or damaged when the first hand is mounted on the first hand shaft. Since the first hand shaft portion is formed of the synthetic resin, its frictional resistance is reduced, so that projections for reducing the frictional resistance can be eliminated to simplify construction of the hand shaft and to readily manufacture the hand shaft.

DETAILED DESCRIPTION OF THE PREFERRED EMBODIMENTS

Figure 1:
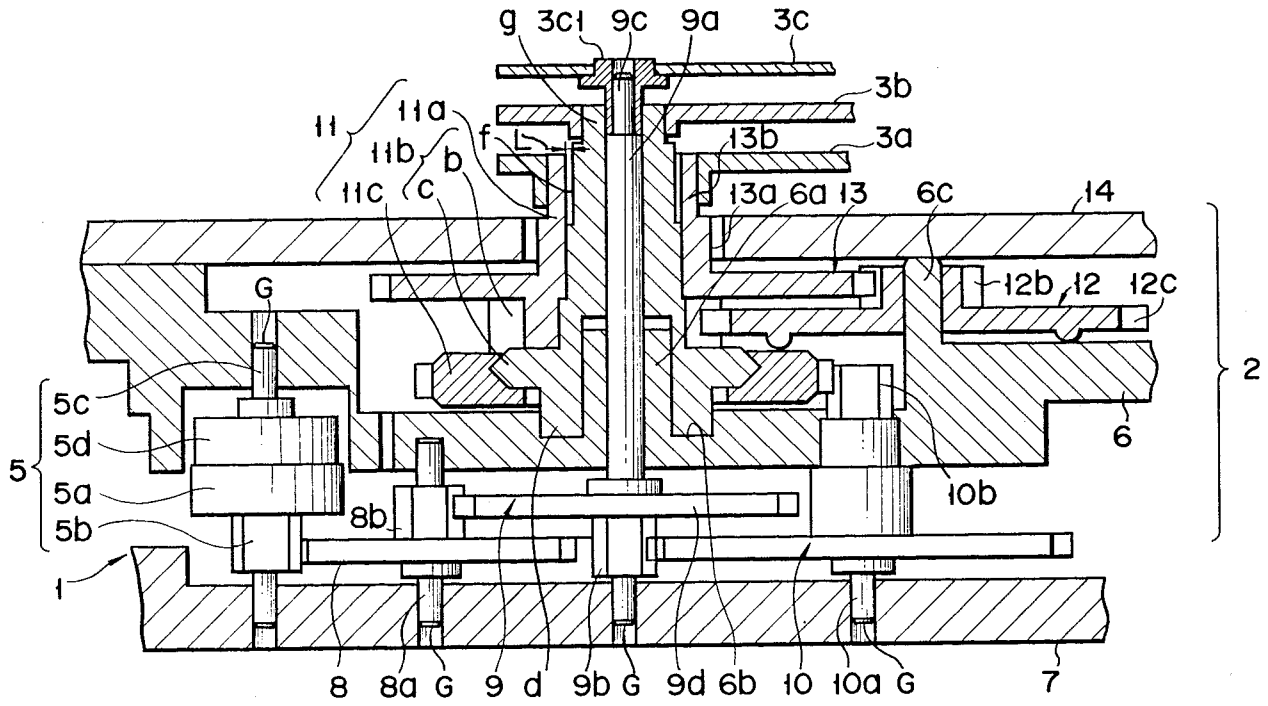
FIG. 1 is a longitudinal sectional view of an analog watch having a synthetic resin hand shaft according to the present invention.
Figure 2:
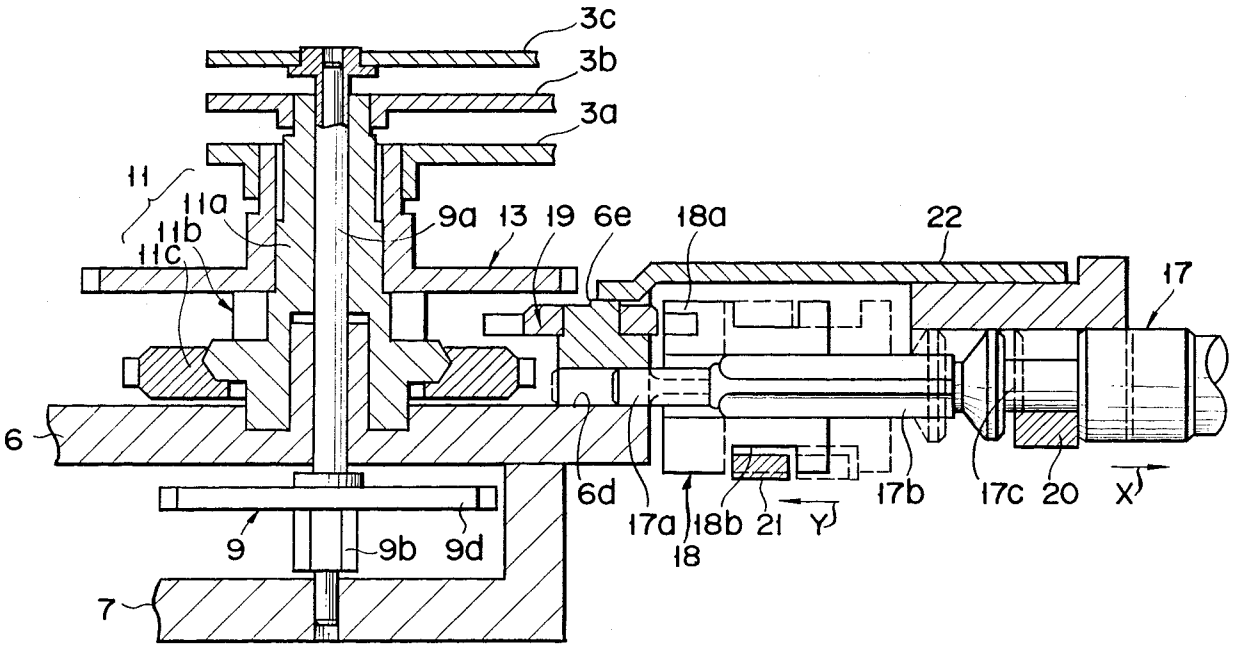
FIG. 2 is a longitudinal sectional view of the analog watch of FIG. 1 at another position.

FIGS. 1 and 2 show an analog movement of a battery powered type wrist watch. This analog movement transmits the rotation of step motor 1 to gear train mechanism 2, which moves hands, such as hour hand 3*a*, minute hand 3*b* and second hand 3*c* to indicate a time, and the hands are set by a time setting mechanism 4.

Step motor 1 is a drive source for moving the hands and is consisted with rotor 5, a stator (not shown), a coil (not shown), and etc. Rotor 5 stepwisely rotates at 180° whenever an inversion pulse of a predetermined period is applied to the coil. Rotor 5 has, as shown in FIG. 1, rotor portion 5*a*, rotor pinion 5*b*, and rotor shaft 5*c*, which are integrally formed of potassium titanate whisker-filled polyacetal resin, and magnet ring 5*d* is mounted on rotor portion 5*a*. Rotor shaft 5*c* is rotatably mounted between a main plate 6 and bearing plate 7. Gate G of rotor 5 for filling resin is provided at the center on the upper end face of rotor shaft 5*c*.

Gear train mechanism 2 serves to transmit the rotation of step motor 1 to the hands to move the hands, and has fifth wheel 8, second wheel 9, third wheel 10, center wheel 11, intermediate wheel 12, hour wheel 13, and etc. Fifth wheel 8, second wheel 9, and third wheel 10 are disposed between main plate 6 and bearing plate 7, and center wheel 11, intermediate wheel 12, and hour wheel 13 are mounted on main plate 6. Main plate 6 and bearing plate 7 are formed of glass fiber-filled polyphenylene sulfide resin (hereinafter referred to as "PPS resin") or glass fiber-filled polyether imide resin, and dial 14 is provided on main plate 6.

The wheels will be described sequentially.

Fifth wheel 8 is rotated in meshing with rotor pinion 5*b* of step motor 1, made of potassium titanate whisker-filled polyacetal resin, and formed integrally with shaft portion 8*a* and intermediate pinion 8*b*, and at the center on the lower end of shaft portion 8*a* gate G for filling resin is provided.

Second wheel 9 is rotated in meshing with intermediate pinion 8*b* of fifth wheel 8 to move second hand 3*c*.

Figure 7:
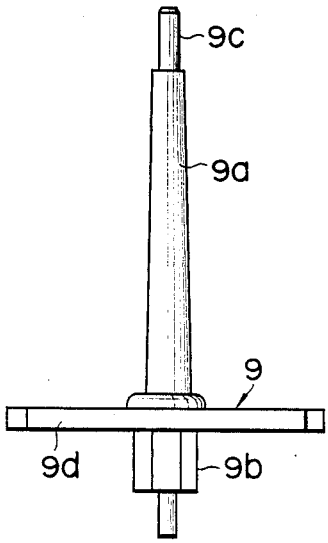
FIG. 7 is a front view of a second wheel of the analog watch of FIG. 1.

Shaft portion 9a of second wheel 9 serves as a shaft for second hand and protrudes upward through bearing portion 6a of main plate 6 and dial 14, and on the protruded portion of shaft portion 9a second hand 3c is mounted. Second wheel 9 is formed of liquid crystal polymer resin which contains 30% of potassium titanate whisker. Shaft portion 9a is integrally formed with second wheel pinion 9b and second wheel gear 9d as shown in FIG. 7.

Figure 10:
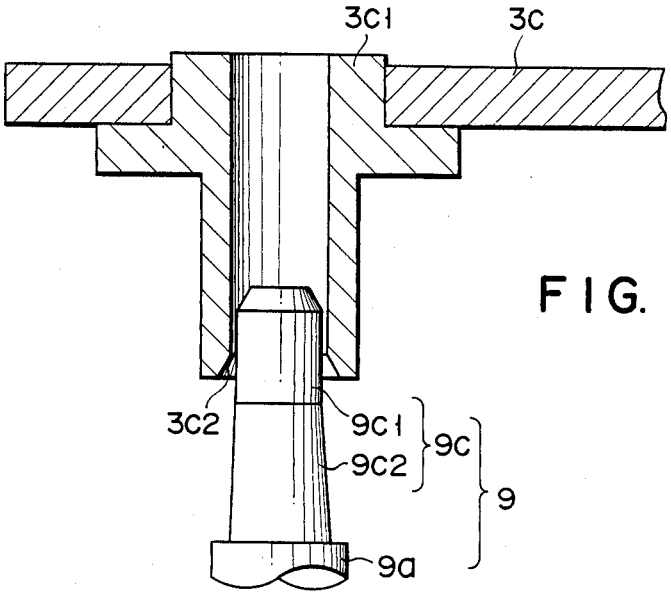
FIG. 10 is a view showing the state that a second hand is mounted on the second wheel of the analog watch of FIG. 7.
Figure 9:
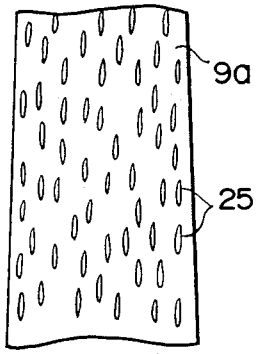
FIG. 9 is a view showing the orientation of the fiber-like reinforcing material in the shaft portion of the second wheel of the analog watch of FIG. 7.
Figure 8:
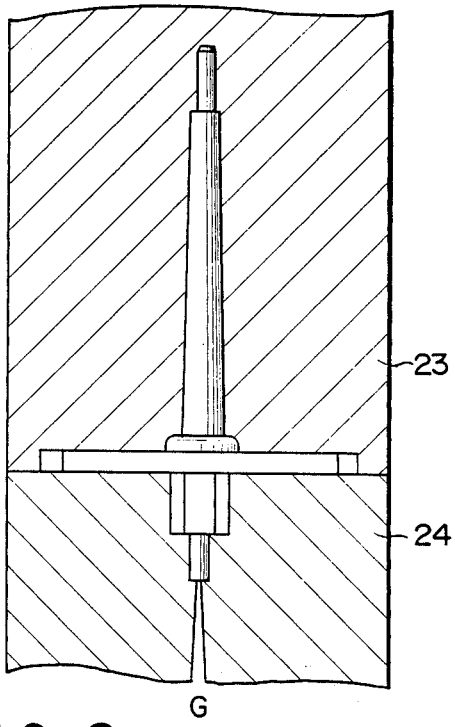
FIG. 8 is a view showing a method for manufacturing the second wheel of analog watch of FIG. 7.

When manufacturing second wheel 9, as shown in FIG. 8, upper and lower metal molds 23 and 24 are used, and potassium titanate whisker-filled liquid crystal polymer resin is poured from resin filling gate G formed in metal mold 24 so as to correspond to the center on the lower end of shaft portion 9a. Then, the flow direction of resin in shaft portion 9a of second wheel 9 is consistent with the longitudinal axis of shaft portion 9a, so that the liquid crystal polymer resin makes an extended molecular chain structure orient in resin flowing direction, i.e., in an axial direction of shaft portion 9a, and the longitudinal axis of potassium titanate whisker 25 is oriented, as shown in FIG. 9, in resin flowing direction, i.e., in an axial direction of shaft portion 9a. The upwardly projecting portion of shaft portion 9a which is projecting upwardly from bearing portion 6a of main plate 6 is formed in a straight columnar shape, and a hand mount 9c thinner than shaft portion 9a is formed, as shown in FIG. 10, at the upper end of the upwardly projecting portion of shaft portion 9a. On hand mount 9c mounting fastener $3c_1$ of second hand 3c is fitted, and the upper side of hand mount 9c is formed as a guide portion $9c_1$ having columnar and at the lower side thereof is formed as a taper portion $9c_2$. Second hand 3c is made of metal, and mounting fastener $3c_1$ is mounted on one end portion of second hand 3c. Mounting fastener $3c_1$ is formed in a cylindrical shape, and guide chamfer (guide chamfered surface) $3c_2$ for guiding hand mount 9c of shaft 9a is formed on the lower end of the inner surface of mounting fastener $3c_1$. Thus, in case of mounting second hand 3c, mounting fastener $3c_1$ of second hand 3c is smoothly guided over guide portion $9c_1$ of hand mount 9c by guide chamfer $3c_2$. When mounting fastener $3c_1$ is further pushed downwardly, mounting fastener $3c_1$ is tightly fitted on taper portion $9c_2$ of hand mount 9c, so that second hand 3c is fixed on shaft portion 9a of second wheel 9. Bearing portion 6a of main plate 6 into which shaft portion 9a is inserted is sufficiently highly formed so that shaft portion 9a of second wheel 9 may not fluctuate at the center.

Third wheel 10 is rotated in meshing with second wheel pinion 9b of center wheel 9, made of potassium titanate whisker-filled polyacetal resin, and integrally formed, as shown in FIG. 1, with shaft portion 10a and third wheel pinion 10b. Third wheel pinion 10b is penetrated through main plate 6 to be protruded upward, and gate G for filling resin is provided at the center on the lower end of shaft portion 10a.

Center wheel 11 is rotated in meshing with third wheel pinion 10b of third wheel 10 to move minute hand 3b. Shaft portion 11b serving as a shaft for minute hand is rotatably mounted on the outer periphery of bearing portion 6a of main plate 6. The upper end of shaft portion 11a is protruded upward through dial 14, and minute hand 3b is mounted on the protruded upper end of shaft portion 11a. Center wheel 11 is formed by two color molding with shaft portion 11a having cylindrical pinion portion 11b and gear portion 11c, gear portion 11c being rotatable with slip over cylindrical pinion portion 11b. Shaft portion 11a is made of potassium titanate whisker-filled PPS resin having high wear resistance and strength and having higher melting temperature than that of the synthetic resin forming gear portion 11c, and gear portion 11c is made of potassium titanate whisker-filled 12 nylon resin having small shrinkage and having lower melting temperature than that of the synthetic resin forming shaft 11a.

Figure 3:
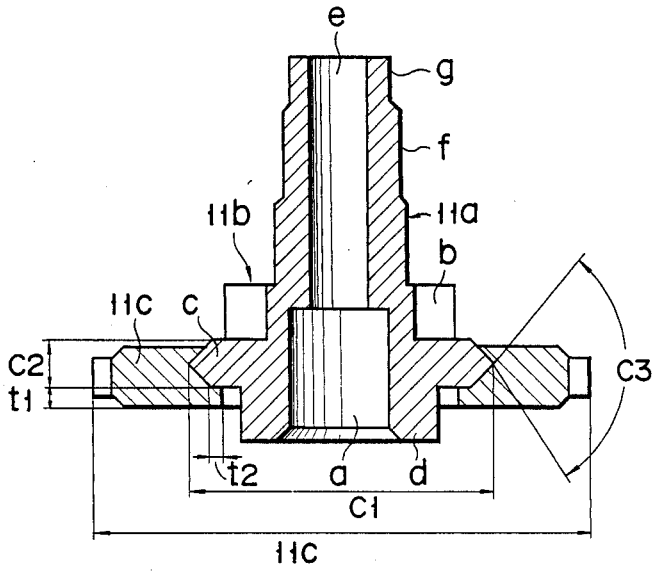
FIG. 3 is a sectional view of a center wheel of the analog watch of FIG. 1.

Center wheel 11 is constructed as shown in FIG. 3. Shaft portion 11a is formed in a cylindrical shape, and cylindrical pinion portion 11b is formed at the lower portion of the shaft portion 11a. The interior of cylindrical pinion portion 11b has a large-diameter hole a, and a pinion b, a projecting portion and an extending portion d are formed on the outer periphery thereof. The upper portion of shaft 11a has a small-diameter hole e, and relief portion f and hand mount portion g are formed on the outer periphery thereof. Large-diameter hole a of cylindrical pinion portion 11b is rotatably fitted over the outer periphery of bearing portion 6a of main plate 6, and its extending portion d extending downwardly is rotatably inserted into annular groove 6b formed on the circumference of bearing portion 6a of main plate 6 and thus held sufficiently so that shaft portion 11a may not fluctuate at the center. Pinion b formed on the outer periphery of cylindrical pinion portion 11b is in meshing with teeth 12c of intermediate wheel 12, and the shape of teeth is involute. Projecting portion c is a portion on which gear portion 11c is molded, and is formed to have a collar shape at the lower side of pinion b. The outer periphery of the projecting portion c has a converged shape toward the radially out end. Outer diameter $c_1$ of the projecting end of projecting portion c is approx. 2.1 mm, the thickness $c_2$ of it is approx. 0.3 mm, and angle $c_3$ of the projecting end is approx. 120°. Gear portion 11c molded on projecting portion c has approx. 3.4 mm of outer diameter, distance $t_1$ projected downward from projecting portion c is approx. 0.15 mm, and distance $t_2$ over which the projecting end of projecting portion c intruded into the gear portion 11c is approx. 0.1 mm. Thus, center wheel 11 has suitable slip torque (3 to 5 g.cm) so that, when the torque (load) larger than this is applied thereto, cylindrical pinion portion 11b (shaft portion 11a) slips on gear portion 11c. Shaft portion 9a of second wheel 9 is inserted into small-diameter hole e in the upper portion of shaft portion 11a. Relief portion f formed on the outer periphery of shaft portion 11a has a smaller diameter than that of shaft portion 11a. Relief portion f faces hand mount portion 13b of cylindrical hour wheel 13 with a predetermined clearance L so that, even if hand mount portion 13b is deformed when hour hand 3a is mounted, hand mount portion 13b may not contact shaft portion 11a of center wheel 11. Hand mount g of the upper end of the shaft portion 11a is a portion to be fitted in minute hand 3b.

Figure 5:
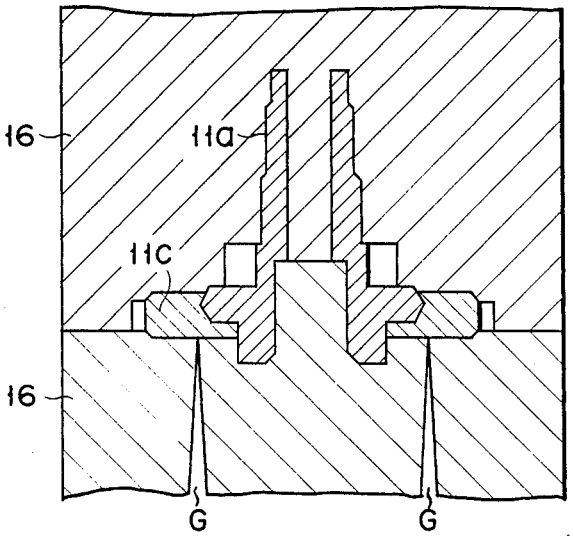
FIGS. 4 and 5 are views showing a method for manufacturing the center wheel of FIG. 3.
Figure 4:
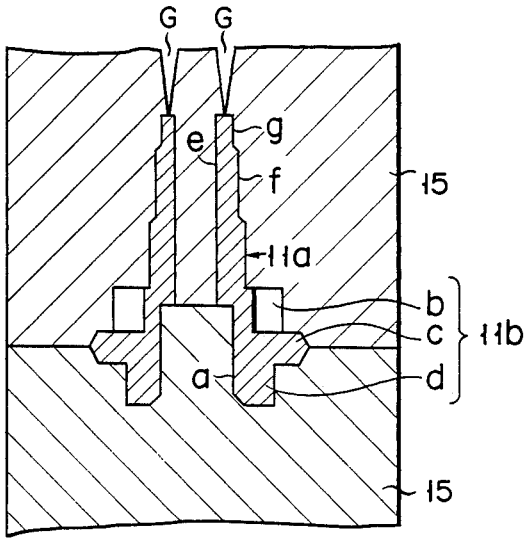
Figure 6:
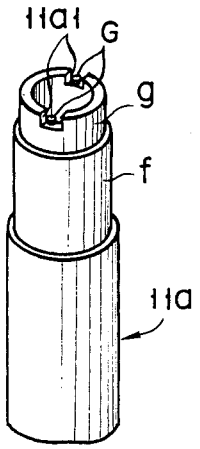
FIG. 6 is a perspective view showing the tip end of the center wheel of FIG. 3.

When forming such second wheel 11, metal molds 15, 16 as shown in FIGS. 4 and 5 are used. Metal molds 15, 16 are associated in a turntable type automatic insert molding machine. As shown in FIG. 4, at first, shaft portion 11a having cylindrical pinion portion 11b is injection molded by a pair of upper and lower primary metal molds 15 and 15. Resin pellet used in this primary molding is crystalline potassium titanate whisker-filled PPS resin which contains several % of silicone oil having thermal resistance of 250° C. or higher. Gate G for filling resin is disposed in each of two recesses $11a_1$ and $11a_1$ formed on the upper end of shaft portion 11a as shown in FIG. 6. After shaft portion 11*a* molded by this manner is removed from primary metal molds 15, 15, shaft portion 11*a* is disposed in a pair of secondary upper and lower metal molds 16, 16. Secondary molding resin is filled from gate G for filling resin formed on lower metal mold 16, so as to mold gear portion 11*c* on shaft portion 11*a* as the primary molded production. The resin pellet used in this secondary molding is the crystalline potassium titanate whisker-filled 12 nylon resin which contains several % of silicone oil having thermal resistance of 250° C. or higher. The center wheel 11 formed in the above described manner is then dipped in mineral oil of approx. 100° C. for approx. 3 hours to be oil annealed. In this case, it is preferable that the temperature of the mineral oil is approx. 80% of thermal deforming temperature and the oil annealing time is longer than 1 hour. Thus, center wheel 11 as shown in FIG. 3 is obtained.

Intermediate wheel 12 is rotated in meshing with pinion b formed on cylindrical pinion portion 11*b* of center wheel 11, and is made of potassium titanate whisker-filled polyacetal resin. Intermediate wheel 12 is molded integrally with intermediate wheel pinion 12*b*, and is rotatably mounted on shaft portion 6*c* projected on the upper surface of main plate 6. In this case, since teeth 12*c* of intermediate wheel 12 mesh with pinion b of center wheel 11, the shape of each teeth 12*c* is the same in volume as that of pinion b.

Hour wheel 13 is rotated in meshing with pinion 12*b* of intermediate wheel 12 to move hour hand 3*a*, and is made of potassium titanate whisker-filled polyacetal resin. Its shaft portion 13*a* is formed in a cylindrical shape, rotatably mounted on the outer periphery of shaft portion 11*a* of center wheel 11, and protruded upward at its upper end above dial 14. The protruded upper end serves as hand mount 13*b*, and hour hand 3*a* is fixed by press-fitting on hand mount 13*b*.

The other gears in gear train mechanism 2 except pinion b of center wheel 11 and gears 12*c* of intermediate wheel 12 are all formed to be cycloidal in toothform.

Time setting mechanism 4 for setting hands has, as shown in FIG. 2, winding stem 17, sliding pinion 18, setting wheel 19, setting lever 20, yoke 21, and etc., and is provided on main plate 6.

More specifically, winding stem 17 is slidably and rotatably provided on main plate 6 to slide and rotate by the operation of a crown (not shown) projected externally of a wrist watch case. Winding stem 17 is made of metal, and is formed at the inside end with guide portion 17*a*, at the right adjacent side of guide portion 17*a* with spline portion 17*b*, and at further right adjacent side of spline portion 17*b* with a stepwise recess portion 17*c*. Guide portion 17*a* is slidably and rotatably inserted into guide hole 6*d* of main plate 6. Sliding pinion 18 is slidably fitted on spline portion 17*b*, and a plurality of spline grooves are formed on the outer periphery thereof. Setting lever 20 is disposed in stepwise recess portion 17*c* to restrict the drawing position of winding stem 17.

Sliding pinion 18 is in meshing with setting wheel 19 by the operation of drawing winding stem 17, and rotated by the rotation of winding stem 17. Sliding pinion 18 is made of carbon fiber-filled PPS resin, formed in a cylindrical shape, formed at the left end face with crown teeth 18*a*, and formed on the outer periphery with recess groove portion 18*b*. The number of teeth of crown teeth 18*a* is 7 and the toothform thereof is involute. Yoke 21 is disposed in groove portion 18*b* to slide sliding pinion 18 by the drawing operation of winding stem 17.

Setting wheel 19 transmits the rotation of sliding pinion 18 to intermediate wheel 12 of gear train mechanism 2 described above, and is made of polyacetal resin which is softer in hardness than sliding pinion 18 and intermediate wheel 12. Setting wheel 19 is rotatably mounted on shaft portion 6*e* projected from the upper surface of main plate 6, and is retained by metal retainer 22 mounted on the top of main plate 6. Since setting wheel 19 is in meshing with both sliding pinion 18 and intermediate wheel 12, its toothform is involute and has 8 of teeth, 1360 microns of pitch circle diameter and 170 microns of module.

Teeth 12*c* of intermediate wheel 12 in meshing with setting wheel 19 have 20 of teeth, 3400 microns of pitch circle diameter and 170 microns of module, and pinion b of center wheel 11 in meshing with teeth 12*c* of intermediate wheel 12 has 8 of teeth, 1360 microns of pitch circle diameter and 170 microns of module.

The operation of analog movement constructed as described above will be described below.

The hands are ordinarily moved by step motor 1 to indicate a time. More specifically, as shown in FIG. 1, when rotor 5 of step motor 1 rotates, the rotation is transmitted through fifth wheel 8 to second wheel 9, which rotates to move second hand 3*c* mounted on the upper end of shaft portion 9*a* of second wheel 9. When second wheel 9 rotates as described above, its rotation is transmitted through third wheel 10 to center wheel 11, which thus rotates. In center wheel 11 shaft portion 11*a* and gear portion 11*c* are combined to be rotatable with slip each other, but in this state shaft portion 11*a* and gear portion 11*c* are integrally rotate because load higher than predetermined value is not applied to center wheel 11. Thus, minute hand 3*b* mounted on shaft portion 11*a* of center wheel 11 moves. When center wheel 11 is thus rotated, its rotation is transmitted through center wheel 11 to hour wheel 13, which rotates to move hour hand 3*a*. Since hour hand 3*a*, minute hand 3*b* and second hand 3*c* move above dial 14, a time is indicated.

When setting the time, winding stem 17 of time setting mechanism 4 shown in FIG. 2 is drawn and rotated in a predetermined amount. More particularly, when winding stem 17 is drawn in a direction of arrow X, setting lever 20 disposed in stepwise recess portion 17*c* of winding stem 17 moves together with winding stem 17 to set winding stem 17 to a predetermined position. Then, yoke 21 moves in a direction of arrow Y by the movement of setting lever 20, sliding pinion 18 is moved along spline portion 17*b* of winding stem 17 in the same direction, and crown teeth 18*a* of sliding pinion 18 is in meshing with setting wheel 19. When winding stem 17 is rotated in this state, its rotation is transmitted through sliding pinion 18 to setting wheel 19, its rotation is transmitted through intermediate wheel 12 to center wheel 11 and hour wheel 13. Thus, center wheel 11 and hour wheel 13 rotate to rotate hour hand 3*a* and minute hand 3*b* to set a time. At this time, torque (rotary force) from winding stem 17 is applied to center wheel 11. When this torque becomes larger than slip torque (3 to 6 g.cm) of center wheel 11, shaft portion 11*a* of center wheel 11 slips on gear portion 11*c*, and shaft portion 11*a* rotates with slip on gear portion 11*c*. Further, when shaft portion 11*a* rotates with slip, thin film of silicone oil is formed on the contacting surfaces of shaft portion 11*a* and gear portion 11*c* to operate as lubricant, thereby shaft portion 11*a* stably and smoothly rotates with slip on gear portion 11*c*. Thus, the minute hand 3*b* and the hour hand 3*a* can be set without rotating the second hand 3*c* and step motor 1.

However, according to the slip mechanism of the above-mentioned analog movement, shaft portion 11*a* of center wheel 11 on which minute hand 3*b* is mounted and gear portion 11*c* are combined to e slip-rotatable each other. Thus, the rotation of step motor 1 is ordinarily transmitted to the hands to accurately move the hands, and, in case of setting or correcting the time, shaft portion 11*a* can be rotated with slip on gear portion 11*c*. Since projecting portion c converged toward its end side is formed on shaft portion 11*a* of center wheel 11 and gear portion 11*c* is molded on projecting portion c, stable slip torque can be obtained in a simple structure, and gear portion 11*c* can be securely and rigidly mounted on shaft portion 11*a*. In this case, shaft portion 11*a* has high wear resistance and high strength, and is made of potassium titanate whisker-filled PPS resin having higher melting temperature than that of the synthetic resin forming gear portion 11*c*. And gear portion 11*c* is made of potassium titanate whisker-filled 12 nylon resin having small shrinkage, and having lower melting temperature than that of the synthetic resin forming shaft portion 11*a*. Therefore, suitable slip torque of approx. 3 to 6 g.cm can be obtained between shaft portion 11*a* and gear portion 11*c*, and if the material is replaced, slip torque of 2 to 10 g.cm can be obtained. Since shaft portion 11*a* and gear portion 11*c* of center wheel 11 are formed by resin pellet in which several % of silicone oil having thermal resistance of 250° C. or higher is mixed, a thin film of silicone oil is formed on the contacting surfaces of shaft portion 11*a* and gear portion 11*c* when the torque more than predetermined value is applied to shaft portion 11*a* to rotate shaft portion 11*a* on gear portion 11*c*. Since the film operates as lubricant, shaft portion 11*a* and gear portion 11*c* can be smoothly rotated. Since they are annealed by dipping in mineral oil of approx. 100° C. for approx. 3 hours after molding, the stress in the resin can be uniformly dispersed, and water absorption capacity of resin can be reduced to prevent the molding from being varied in dimensions due to water absorption, thereby obtaining high accuracy. Since shaft portion 11*a* and gear portion 11*c* of center wheel 11 are automatically formed by the two color molding in the turntable type molding machine, it has excellent productivity and extremely ready manufacture. In the molding of shaft portion 11*a*, since two recesses 11*a*$_1$ and 11*a*$_1$ are formed on the upper end face of shaft portion 11*a* and resin filling gates G are formed in recesses 11*a*$_1$ and 11*a*$_1$, the resin can be uniformly filled in the metal molds to accurately mold shaft portion 11*a*. Since extending portion d is formed at the lower end of center wheel 11 and is rotatably inserted into annular groove 6*b* formed in circumference of the outer periphery of bearing portion 6*a* of main plate 6, the entire analog movement is not increased in thickness even if the thickness of main plate 6 is increased to obtain sufficient strength in case of molding main plate 6 with the synthetic resin, and center wheel 11 can be preferably held by bearing portion 6*b* to eliminate the fluctuation of the center thereof. Since relief portion f is formed on the outer periphery of shaft portion 11*a* of center wheel 11 to face hand mount 13*b* of hour wheel 13, shaft portion 13*a* of hour wheel 13 does not contacted shaft portion 11*a* of center wheel 11 even if shaft portion 13*a* of hour wheel 13 is deformed when hour hand 3*a* is fitted on hand mount 13*b* of hour wheel 13, so that center wheel 11 and hour wheel 13 can be smoothly rotated.

In the wheels used in gear train mechanism 2 of the analog movement described above, each of rotor 5, fifth wheel 8, second wheel 9, and third wheel 10, mounted between main plate 5 and bearing plate 7, is uniformly filled with synthetic resin at the molding time so that the size thereof becomes accurate since resin filling gates G are formed at the centers of the end faces of shaft portions 5*a*, 8*a*, 9*a* and 10*a*. Particularly, since second wheel 9 is molded by filling potassium titanate whisker-filled liquid crystal polymer resin from the resin filling gate G formed at the center of the lower surface of shaft portion 9*a*, the resin flows along the longitudinal axis of shaft portion 9*a* of second wheel 9, and the liquid crystal polymer is oriented its extended molecular chain structure in resin flowing direction, i.e., the axial direction. The potassium titanate whiskers filled in the liquid crystal polymer are extremely small such as 0.2 to 0.5 microns of fiber diameter and 10 to 20 microns of length. Thus, since the longitudinal axes of the whiskers are oriented in the resin flowing direction, the strength in the axial direction of shaft portion 9*a* is increased. Therefore, when second hand 3*c* is fitted on the upper end of shaft portion 9*a* of second wheel 9, shaft portion 9*a* is not bent nor damaged, and second hand 3*c* can be fixed very securely and rigidly. In this case, shaft portion 9*a* of second wheel 9 is formed in a straight columnar shape. This simple shapes enables the simple and easy molding. Since hand mount position 9*c* formed on the upper end of shaft portion 9*a* has a of guide portion 9*c*$_1$ and taper portion 9*c*$_2$, mounting fastener 3*c*$_1$ is smoothly guided by guide portion 9*c*$_1$ when mounting fastener 3*c*$_1$ of second hand 3*c* is fitted on hand mount 9*c*, and it is securely and rigidly press-fitted on taper portion 9*c*$_2$ when it is further inserted. Thus, the mounting operation of mounting fastener 3*c*$_1$ is extremely simple. Further, since chamfer 3*c*$_2$ is formed on the lower end of the inner surface of hand mount 3*c*$_1$ of second hand 3*c*, hand mount 3*c*$_1$ can be extremely smoothly and preferably press-fitted on the hand mount 9*c* of shaft portion 9*a* without calking hand mount 3*c*$_1$ on the outer peripheral surface of shaft portion 9*a* of second wheel 9 at the mounting time.

In the embodiments described above, the liquid crystal polymer resin has been used as the resin material for the second wheel. However, polyether imide resin may be used as the resin material for the second wheel. The reinforcing material is not limited to the potassium titanate whiskers, but glass fiber, carbon fiber, reduced potassium titanate whiskers, and etc. may be used if it is fibrous, and the content may be altered according to the material of the resin and the shape of the hand shaft.

In the embodiments described above, the present invention has been applied to the hand shaft for the second hand. However, the present invention may also be applied to the hand shaft for the minute hand.

The present invention is not limited to the hand shaft of an analog watch, but may also be applied to the hand shaft of an analog type stop watch, and to the hand shaft of an analog type meter.

What is claimed is:

1. A rotatable hand shaft apparatus formed of synthetic resin for use in an analog display device, comprising:

a first hand shaft portion, on which a first hand is mounted so as to be rotatably driven therewith, said first hand shaft portion being formed of a synthetic resin in which fibrous reinforcing materials are contained, said first hand shaft portion having a longitudinal axis, and said fibrous reinforcing materials comprising a plurality of elongated fibers substantially all of which have respective longitudinal axes arranged substantially parallel to said longitudinal axis of said first hand shaft portion; and a second hand shaft portion to the end of which a second hand is mounted, said second hand shaft portion having an insertion hole therein, said first hand shaft portion having an end which is insertable into said insertion hole so as to connect said first and second hand shaft portions together.

2. An apparatus according to claim 1, wherein said first hand shaft portion is formed in a columnar shape, and has a columnar surface contacting an inner peripheral surface of said insertion hole of said second hand shaft portion.

3. An apparatus according to claim 1, wherein said resin material for said first hand shaft portion comprises a liquid crystal polymer.

4. An apparatus according to claim 1, wherein said resin material for said first hand shaft portion comprises a polyether imide resin.

5. An apparatus according to claim 1, wherein said fibrous reinforcing material contained in resin material for said first hand shaft portion comprises potassium titanate whiskers.

6. An apparatus according to claim 1, wherein said fibrous reinforcing material contained in said resin material for said first hand shaft portion comprises reduced potassium titanate whiskers.

7. An apparatus according to claim 1, wherein said fibrous reinforcing material contained in said resin material for said first hand shaft portion comprises glass fibers.

8. An apparatus according to claim 1 wherein said second hand shaft portion is formed of a synthetic resin.

9. An apparatus according to claim 1, comprising a hand-mount formed at one end of said first hand shaft portion, said hand-mount having a guide portion at an end side thereof and a tapered press-fitted portion formed in the vicinity of said guide portion; and wherein said insertion hole of said second hand shaft portion is press-fitted through said guide portion and into said tapered press-fitted portion.

10. An apparatus according to claim 1, wherein a gate means for filling resin for said first hand shaft portion during molding thereof is disposed on the lower surface of said first hand shaft portion.

11. An apparatus according to claim 1, wherein said apparatus is an analog watch, and said first and second hands indicate a time.

12. An apparatus according to claim 11, wherein said first hand is a seconds hand, and said second hand is a "minute" hand.

13. An apparatus according to claim 11, wherein said first hand is a "minute" hand and said second hand is an "hour" hand.

14. An apparatus according to claim 1, wherein said apparatus is a stop watch, and wherein said first and second hands indicate a measuring time.

15. A watch apparatus comprising a rotatable hand shaft formed of synthetic resin, the hand shaft comprising:

a first hand shaft portion, on which a "second" hand is mounted so as to be rotatably driven therewith, said first hand shaft portion being formed of a synthetic resin in which fibrous reinforcing materials are contained, said first hand shaft portion having a longitudinal axis, and said fibrous reinforcing materials comprising a plurality of elongated fibers substantially all of which have respective longitudinal axes arranged substantially parallel to said longitudinal axis of said first hand shaft portion;

a second hand shaft portion to the end of which a "minute" hand is mounted, said second hand shaft portion having an insertion hole therein, said first hand shaft portion having an end which is insertable into said insertion hole of said second hand shaft portion so as to connect said first and second hand shaft portions together, the rotation of said first hand shaft portion being transmitted through a gear to said second hand shaft portion; and a third hand shaft portion to the end of which an "hour" hand is mounted, said third hand shaft portion having an insertion hole therein, and said second hand shaft portion having an end which is insertable into said insertion hole of said third hand shaft portion so as to connect said second and third hand shaft portions together, the rotation of said second hand shaft portion being transmitted through a gear to said third hand shaft portion.

16. A watch apparatus according to claim 2, wherein said first hand shaft portion is formed in a columnar shape, and has a columnar surface contacting an inner peripheral surface of said insertion hole of said second hand shaft portion.

17. A watch apparatus according to claim 2, wherein said resin material for said first hand shaft portion comprises a liquid crystal polymer.

18. A watch apparatus according to claim 2, wherein said resin material for said first hand shaft portion comprises a polyether imide resin.

19. A watch apparatus according to claim 2, wherein said fibrous reinforcing material contained in said resin material for said first hand shaft portion comprises potassium titanate whiskers.

20. A watch apparatus according to claim 2, wherein said fibrous reinforcing material contained in said resin material for said first hand shaft portion comprises reduced potassium titanate whiskers.

21. A watch apparatus according to claim 2, wherein said fibrous reinforcing material contained in said resin material for said first hand shaft portion comprises glass fibers.

22. A watch according to claim 2, wherein said second hand shaft portion is formed of a synthetic resin.

23. A watch apparatus according to claim 2, comprising a hand-mount formed at the end of said first hand shaft portion, said hand-mount having a guide portion at an end thereof and a tapered press-fitted portion formed in the vicinity of said guide portion; and wherein said insertion hole of said second hand shaft portion is press-fitted through said guide portion and into said press-fitted portion.

24. A watch apparatus according to claim 2, wherein a gate means for filling resin for said first hand shaft portion during molding thereof is disposed on the lower surface of said first hand shaft portion.

* * * * *